United States Patent [19]

Seeling

[11] 4,004,491

[45] Jan. 25, 1977

[54] PLASTIC AMMUNITION BELT

[75] Inventor: Ernest Richard Seeling, Davenport, Iowa

[73] Assignee: The United States of America as represented by the Secretary of the Army, Washington, D.C.

[22] Filed: Sept. 17, 1975

[21] Appl. No.: 614,285

[52] U.S. Cl. ..... 89/35 R; 89/33 CA

[51] Int. Cl.[2] ..... F42B 39/08

[58] Field of Search ..... 89/35 R; 221/25; 206/3, 206/343, 344, 820

[56] References Cited

UNITED STATES PATENTS

| | | | |
|---|---|---|---|
| 1,286,877 | 12/1918 | Graham | 221/25 |
| 1,290,842 | 1/1919 | Mottin | 89/35 R |
| 2,472,861 | 6/1949 | Schaich | 89/35 R |
| 3,706,260 | 12/1972 | Ravsina | 89/35 R |

*Primary Examiner*—Stephen C. Bentley
*Attorney, Agent, or Firm*—Nathan Edelberg; Harold H. Card, Jr.; Robert O. Richardson

[57] ABSTRACT

An ammunition belt comprising a plurality of joined plastic strips of a predetermined length, the strips being of different tensile strengths, one of the strips being a driven strip carrying the dynamic force load of the moving belt and weight of the ammunition being fed into the weapon and the second strip of lower tensile strength formed into a plurality of ammunition receiving loops or apertures, the looped strip including a plurality of spaced transverse perforations, one perforation being located adjacent each loop to permit transverse tearing of each loop while under a predetermined tension whereby each cartridge is sequentially removable from the belt.

3 Claims, 3 Drawing Figures

PLASTIC AMMUNITION BELT

GOVERNMENT INTEREST

The invention described herein may be manufactured and/or used by or for the Governement for governmental purposes without the payment of any royalty thereon.

BACKGROUND OF INVENTION

Currently most automatic weapon systems utilize belts made of metal links. Belts are of the continuous joined link type or the disintegrating type. Many different configurations of links have been tested and used depending on factors, such as ammunition design, feed tray design, firing chamber design and pitch requirements defined by the belt and firing chamber design. The requirements of stripping and delinking of cartridges from belts also presents problems. In some systems, the cartridge is stripped forward from the belt by forward motion of a rammer. In other systems, the cartridge is extracted rearwardly and then fed to the firing chamber. Lateral stripping is also used on some systems. In still other systems the linked cartridges are fed while linked into the firing chamber.

The weight of the moving belt during firing imposes limitations on the firing capability of the systems as well as the effects of surge and spike loads of the moving belt. While some prior art belts have been utilized which were constructed of flexible fibrous or plastic materials wherein the cartridges are disposed in a plurality of spaced apart pockets, these have not been generally adopted in practice because the foregoing problems and difficulties were not overcome, particularily where the weapon system mechanism strips the cartridges forwardly from the path of movement of the belt into the firing chamber.

SUMMARY OF THE INVENTION

These and other problems, difficulties and disadvantages of the prior art are substantially overcome by utilization of the present invention by employment of a two ply ammunition belt constructed of a strip of plastic driven by external means which carries the dynamic force loads of the moving belt and a second plastic strip carried by the first strip with the second strip formed into a plurality of ammunition receiving loops or apertures, the looped strip also having a transverse perforation or serration near each loop to permit tearing or opening of each loop under a predetermined tension so that each round may be removed from the belt for subsequent positioning of each round for firing thereof in the weapon.

BRIEF DESCRIPTION OF DRAWINGS

These and other objects, features, and advantages of the present invention will become readily apparent to one skilled in the art from a reading of the following description, when read in connection with the accompanying drawing, wherein like and corresponding reference numerals refer to like and corresponding parts throughout the several views and wherein.

DESCRIPTION OF PREFERRED EMBODIMENT

Figure 1:
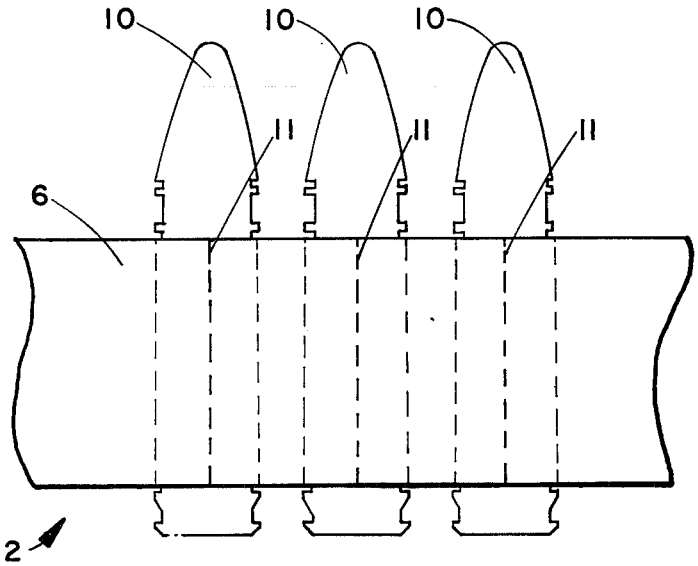
FIG. 1 is a fragmentary top plan view of an ammunition belt constructed in accordance with the present invention.
Figure 2:
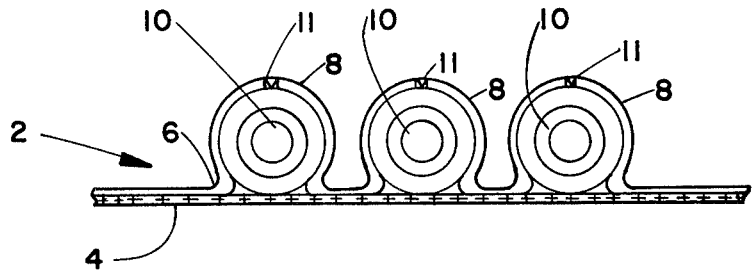
FIG. 2 is a side view of the belt of FIG. 1.

Referring to FIGS. 1 and 2, there is shown a plastic ammunition belt 2 of the present invention. The belt is of two-ply construction. The bottom plastic strip 4 is of greater tensile strength than the upper plastic strip 6. A suitable plastic material for construction of the bottom strip 4 is a plastic material, such as "Scotch Pak" sold under that trade name by Minnesota Mining and Manufacturing Company. This is a polyester material reinforced with nylon cord. The material of construction of the bottom strip 4 is selected so that it will withstand the dynamic force loads of the moving belt and also carry the weight of the ammunition in the belt while the rounds are being stripped from the belt.

The upper strip 6 is heat sealed to the bottom strip 4 to form cartridge receiving pockets 8 for the cartridges 10. The upper strip 6 is preferably formed of polyethylene vinyl acetate film material, such as Mil. Spec. 32404 ethylene vinyl copolymer sold under that trade name by Union Carbide Corporation. The material of construction of the upper strip is selected primarily on the basis of its capability of carrying the weight of each round in each of the loops or pockets 8. Since it need not withstand the force loads on the belt and since it must rupture in the removal of the cartridge, this material is of lighter weight than the bottom strip 4.

A plurality of weakened areas 11 are provided in the upper strip 6 by transversely serrating or perforating the strip 6 adjacent each of the loops 8 across the width of the strip 6. As shown in FIG. 1, the weakened areas 11 are each located in the same position adjacent to each loop for uniform application of a tearing shear force provided by external means.

It will be appreciated that manufacture of the plastic ammunition belt of the present invention is quite simple involving a heat sealing operation to secure the strips and form the pocket, a perforating operation before the cartridges are loaded into the loops, and a cartridge loading operation.

Figure 3:
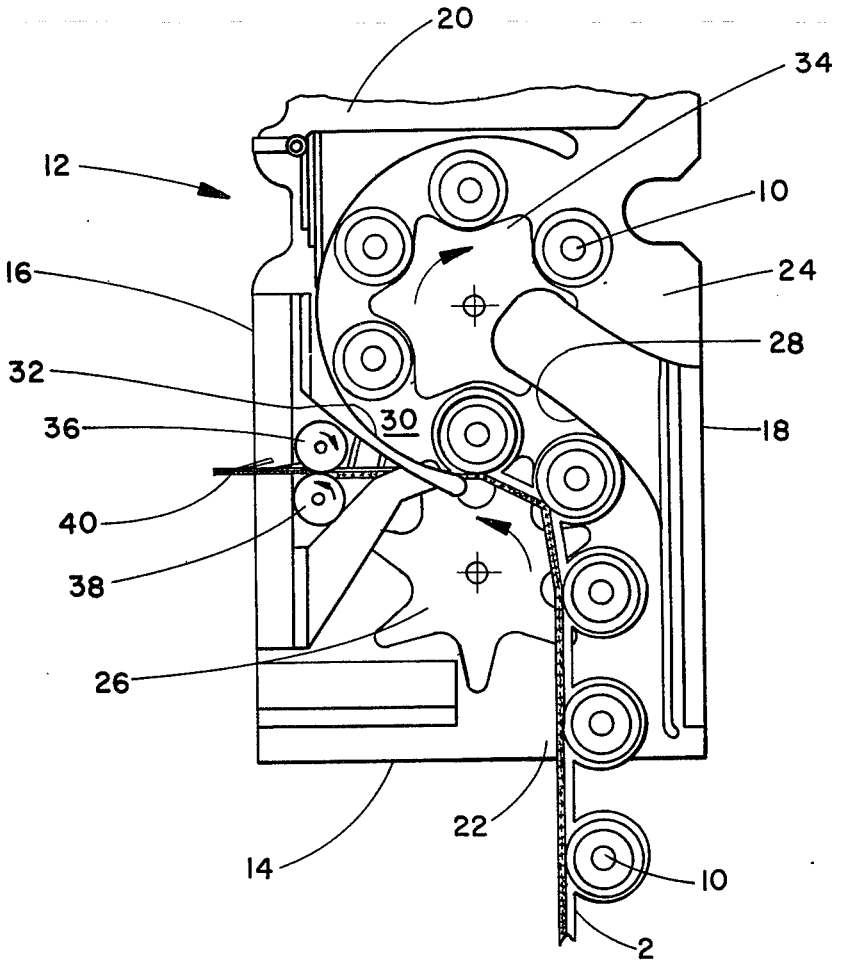
FIG. 3 is a side view of an ammnuition feed tray modified in accordance with the present invention for stripping ammunition from the plastic belt of Fig. 1.

One assembly for separating cartridges from the belt by separation of the upper strip at the perforation lines 11 as shown in FIG. 3. The assembly, generally indicated by the numeral 12, is a feeder assembly having a base 14, four upright walls, three of which are shown in FIG. 3, walls 16–18 and 20. The feeder assembly 12 includes a lower belt inlet 22 and an upper cartridge outlet 24. A lower sprocket assembly 26 cooperates with a lower arcuate guide surface 28 to feed the belted cartridges to an intermediate stripping area 30. In the stripping area 30, arcuated guide means 32 cooperate with an upper sprocket assembly 34 to then guide stripped cartridges to the outlet 24.

To cause separation of the upper strip loops 8 at their perforation lines 11, the belt is fed between a pair of opositely rotating rollers 36 and 38 which apply tension linearly to the belt in an amount sufficient to separate the upper strip along the loop perforation lines 11 as control of movement of each round is assumed by the guide 32 and upper sprocket 34 in the stripping area 30.

It will be appreciated that the used belt 40 can be rapidly disposed of and the weight of the belt is considerably reduced compared to the weight of a metal belt. Moreover, the space requirements for the plastic belt in ammunition containers, etc., is substantially non-existent.

It is to be understood, that, although a preferred embodiment of the present invention has been shown and described herein, the present invention is not limited thereto, because variations and other embodiments will become readily apparent to those skilled in the art from the foregoing description. Accordingly, the present invention should be considered limited only by the scope of the following claims.

I claim:

1. A cartridge belt comprising a single lower strip of cord reinforced flexible polyester material, an upper strip of polyethylene vinyl acetate film material of lighter weight than said lower strip, said upper strip being heat sealed to said lower strip in transverse spaced intervals to form a plurality of tubular cartridge receiving pockets on said strip transversely thereof, said pockets being disposed in predetermined spaced apart relation along said strip and adpated to receive cartridges therein, a longitudinal weakened area along each one of said pockets remotely disposed from said lower strip which is responsive to being torn incident to lateral removal of a cartridge therefrom.

2. The invention as defined in claim 1 wherein said weakened area comprises a plurality of spaced apart perforations.

3. The invention as defined in claim 1 wherein said strip material is reinforced with nylon cord.

* * * * *